US007240936B2

(12) United States Patent
Petzitillo, Jr. et al.

(10) Patent No.: US 7,240,936 B2
(45) Date of Patent: Jul. 10, 2007

(54) LID LOCKING MECHANISM FOR A SPREADER TWISTLOCK

(75) Inventors: Anthony D. Petzitillo, Jr., Winslow, NJ (US); Todd A. Fowler, Sewell, NJ (US)

(73) Assignee: Wastequip, Inc., Cleveland, OH (US)

( * ) Notice: Subject to any disclaimer, the term of this patent is extended or adjusted under 35 U.S.C. 154(b) by 0 days.

(21) Appl. No.: 11/011,846

(22) Filed: Dec. 14, 2004

(65) Prior Publication Data

US 2005/0127694 A1 Jun. 16, 2005

Related U.S. Application Data

(60) Provisional application No. 60/529,866, filed on Dec. 16, 2003.

(51) Int. Cl.
*B66C 1/42* (2006.01)

(52) U.S. Cl. ..... 294/81.53

(58) Field of Classification Search ..... 294/81.53, 294/68.3, 81.1; 220/1.5; 410/82
See application file for complete search history.

(56) References Cited

U.S. PATENT DOCUMENTS 3,493,258 A * 2/1970 Wyrough ..... 294/81.53
3,712,661 A * 1/1973 Strand ..... 294/81.53
3,958,824 A * 5/1976 Crews et al. ..... 294/68.3
3,973,684 A 8/1976 DiMartino
3,980,185 A * 9/1976 Cain ..... 294/81.53
4,212,251 A 7/1980 DiMartino
4,341,495 A * 7/1982 Del'Acqua ..... 294/81.53
4,352,613 A 10/1982 Bertolini
4,358,145 A * 11/1982 Svensson ..... 294/68.3
4,741,449 A * 5/1988 Bersani ..... 220/1.5
5,052,734 A * 10/1991 Hasegawa et al. ..... 294/81.53
5,806,701 A * 9/1998 Bae ..... 220/1.5
5,816,423 A * 10/1998 Fenton et al. ..... 220/1.5
6,109,052 A * 8/2000 Austin, Jr. ..... 62/259.1
6,364,153 B1 * 4/2002 Petzitillo et al. ..... 220/812
6,877,939 B2 * 4/2005 Tomkins et al. ..... 410/46

* cited by examiner

*Primary Examiner*—Patrick Mackey
*Assistant Examiner*—Paul T. Chin
(74) *Attorney, Agent, or Firm*—Duane Morris LLP

(57) ABSTRACT

A lid locking device enables engagement of a container lid for handling, particularly for an intermodal container, and also enables locking and unlocking of the lid to the container. The lid has fittings disposed at each of its four corners, with recesses for rotatable twistlocks carried on a lifting spreader. The lid and the intermodal container have corresponding twistlock fittings, preferably operated in opposite directions, configured to engage so that the container twistlock can be locked and unlocked using an actuator attached to the spreader twistlock, which likewise can be locked an unlocked. The lid is initially engaged to the spreader using the spreader twistlocks, and the spreader is used to move the lid into position on top of the container. As the lid is placed on the container, the container twistlocks insert into the recesses in the lid fittings. The actuator is rotated, concurrently locking the lid to the container and unlocking the lid from the spreader.

17 Claims, 8 Drawing Sheets

LID LOCKING MECHANISM FOR A SPREADER TWISTLOCK

CROSS-REFERENCE TO RELATED APPLICATION

This application claims priority to pending U.S. provisional patent application Ser. No. 60/529,866, filed Dec. 16, 2003, the entire contents of which are hereby incorporated.

FIELD OF THE INVENTION

The invention relates to cargo containers, particularly for bulk material such as solid waste, to be opened or closed by a detachable lid. The lid has several fittings to be engaged by a spreader for manipulation of the lid, and optionally can be used to lift or move the whole container. The fittings use twistlock devices.

The twistlock devices can comprise non-round elements carried on a shaft on one structure, which elements fit through non-round complementary openings in a plate attached to a second structure, so that when rotated through an arc, the twistlocks attach the two structures together against separation in a direction parallel to the shaft axis.

There are three structures involved for the subject containers, namely the container, the lid and the spreader. According to the invention, at each of four corners, the spreader-to-lid-to-container engagement involves two serial-arranged twistlocks, one for connecting or disconnecting the spreader and the lid, and the other for connecting or disconnecting the lid and the container. The twistlocks are operable separately, but advantageously also engage rotationally together for cooperative operation when passing the lid from a state of attachment with the container (wherein the spreader is detached and can be removed) and a state of attachment with the spreader (wherein the spreader can lift the lid away), or vice versa.

In the disclosed example, the two serial twistlocks are oriented oppositely, i.e., nose to nose. The twistlocks use openings in axially spaced plates on the lid. The oppositely oriented twistlocks respectively engage with one of two axially spaced plates in the lid. In addition to being operable in a normal way as insert-and-twist attachment mechanisms, the spreader twistlocks (for the spreader-to-lid engagement) and the oppositely oriented lid twistlocks (for the lid-to-container engagement) also become rotationally connected to one another. The spreader and lid twistlocks interact due to their connection and define plural states by which the lid is transferred back and forth from a state in which the lid is mechanically attached only to the container and a state in which the lid is mechanically attached only to the spreader. Therefore, by engaging and moving the twistlocks on the container, the lid can be detached from the container and attached to the spreader, or vice versa.

According to a preferred arrangement, the same motion that locks the spreader to the container lid, also unlocks the lid from the container. Conversely, the same motion that locks the lid to the container, also unlocks the spreader from the lid. Thus the spreader is not only useful to manipulate the lid, but moreover, the process of engaging or disengaging the lid, respectively disengages or engages the lid connection with the container.

In a disclosed example, the opposite twistlocks engage with one another when their non-round laterally elongated shapes are aligned. In that case the openings in the spaced plates are rotationally offset, e.g., by 90 degrees. It would also be possible to have the twistlocks become engaged when rotationally offset and/or to use a different specific angular or gender relationship to achieve the same functional arrangement of axially successive stages wherein complementary parts that are axially inserted or received, then being relatively rotated to lock, rotationally engage from one stage to the next, for coordinated operation as described.

According to additional aspects, the container is configured for optimal usefulness in connection with loading through the uncovered top, closure, transport and endwise emptying.

BACKGROUND

Bulk materials, finished products, parts and components, and also waste materials are frequently transported in large containers that resemble the body portions of semi trailers apart from the undercarriage and wheels. When configured with fittings for engagement with standardized lifting and manipulation fittings, the same containers are useful for transport by ship, rail or roadway, i.e., as intermodal containers.

There are a number of standard sizes for intermodal containers. A typical container short size container is approximately twenty feet long, six to eight feet wide and four to twelve feet deep. Another standard size is forty feet in length. Fittings for cranes and other handling devices are provided, for example, at all eight corners. The fittings can be engaged by manipulators or received by fixed berthing fittings on a ship deck or hold, or on a rail or truck transport bed. The same sort of fittings can attach between the corners of adjacent or stacked containers to secure the containers as well as to align the containers in a registered stack or array.

The corner fittings typically have plates or cast hollow boxes, with oblong entry holes. The devices that engage in the corners, namely the twistlocks, have non-round insertion parts with cross sections that are complementary to the entry holes. When inserted, the insertion parts are rotated on their shafts, e.g., by 90 degrees, using any of various manual or powered mechanical drive means. The rotation renders the cross sections no longer complementary, thereby preventing axial withdrawal without first re-aligning the non-round insertion part with the entry hole. Various types of twistlocks are known. One supplier is Tandemloc, Inc., 824 Highway 101, Havelock, N.C. 28532, tel. (252)447–7155.

Intermodal containers most typically are closed by permanently attached walls except at end doors. One or more doors might be hung on vertical hinge axes for access or on a horizontal hinge axis for dumping. It is known, however to outfit a container with openings such as an open top. A variety of open top containers are available, for example from Wastequip, Inc., 25800 Science Park Drive, Cleveland, Ohio 44122, tel. (216) 292–2554.

A container with a top opening can be fitted with a lid or cover to prevent the escape of loose material from the container and to prevent ingress of water. Among other possibilities, tarpaulin covers, sliding lids and hinged top doors can be used as covers. Advantageously, a lid arrangement can cover just a portion of the top opening of the container. The lid might also cover a top opening that is bounded at a perimeter defined by the outer walls of the container.

Certain roll-top arrangements are available from Wastequip (see for example, U.S. Pat. No. 6,364,153—Petzitillo). The lid is arranged to roll to one side wall and then to pivot to move clear of the opening. These arrangements require two distinct structures. One structure is the rolling and pivoting support mechanism that handles moving the lid over the open top of the container or clear of the open top. A second structure is provided for affixing the lid onto the container when in place. The lid is not related to any intermodal fittings or to any devices such as twistlocks that resemble intermodal fittings.

A roll top is convenient in relatively small containers. For larger containers, the lid may be too large to be manipulated by one or two people. It is possible to provide a lid that is placed or lifted in a vertical direction from an opening atop the container. Such a lid can be handled by a crane equipped with an engagement device. A frame, known as a spreader, can be suspended from a crane and has members placed to attach to the lid at spaced points such as at the four corners of a rectangular lid. this allows the position of the lid to be controlled by the position of the spreader frame.

A lid-lift spreader generally conforms to an outer rectangular dimensions of the lid and is much the same as the sort of spreader that is used to engage with the intermodal fittings at the corners of containers, when lifting a whole container as opposed to the lid alone. The engagement devices therefore can comprise four twistlocks. The engagement devices and the lid engagement devices (like intermodal corner structures) have mating non-round male and female elements. These elements are aligned, axially inserted, and relatively rotated. This locks the elements so that the spreader is engaged to the lid (or to the intermodal container) and the crane can lift and manipulate the lid (or the container) as needed. Engaging and lifting the lid is a different problem from attaching the lid to the container.

Current lids are designed to engage a raised lip disposed about the rim of the opening at the top of the container. The lid is designed to fit over and around the lip and is thus generally prevented from being laterally dislodged from the opening. A separate lid locking mechanism may be provided to prevent tampering with the container contents or to further assure that the lid will stay in place on the container.

It would be desirable to combine the beneficial features of a mechanism for engaging and manipulating a lid for an intermodal container with a locking mechanism that will assure retention of the lid on top of the container.

SUMMARY OF THE INVENTION

A handling system with complementary spreader, container lid and intermodal container are provided according to the invention wherein the same handling system that is used for engaging and lifting or placing the lid, also affixes or detaches the lid from the container. According to another aspect, these two distinct operations of engaging for lifting versus attachment/detachment, are both provided by operation of a temporarily engaged pair of oppositely oriented twistlocks, specifically twistlocks that attach or detach the spreader to the lid and the lid to the container, respectively.

The system may comprise a container, a lid and a lifting spreader. The container may have a top portion with an opening for passing materials to be loaded into or unloaded from the container. The opening defined in the top portion can be a limited part of the top area of the container, or the opening can define the whole top area (i.e., the top portion can be a frame or other perimeter-defining structure at the tops of the container side walls). The top portion can have at least one rotatable twistlock fixture, disposed near the opening. The lid may be configured to engage the container and to cover at least a portion of the opening, or alternatively the whole opening, and potentially overlapping the top portion for a distance around the opening in one or more directions.

The lid may further have at least first and second engagement recesses, the first recess being configured to receive the rotatable twistlock when the lid engages the container. The spreader may be configured for engaging and manipulating the lid. Thus, the spreader may have at least one rotatable twistlock for engaging the second recess in the lid. The spreader twistlock may further be configured to receive a portion of the container twistlock when the spreader engages the lid.

According to one embodiment, the twistlock fixtures associated with engaging, lowering, attaching, detaching and/or lifting the lid relative to the container, are not the same intermodal twistlock fixtures that might be mounted at the corners of the container for manipulating the container as a whole. According to another embodiment, the intermodal corner-mounted twistlocks are indeed used as the fixtures to which the lid is attached or detached, permitting the container to be manipulated using the same spreader that can be used to manipulate the lid.

The twistlock associated with the container may have unlocked and locked positions. In the unlocked position the container twistlock may be receivable within the first recess of the lid. In the locked position at least one dimension of the container twistlock is greater than a corresponding dimension of the respective first recess, such that axial insertion and rotation or other lateral displacement serves to lock the lid to the container in the axial direction.

The spreader twistlock also may have unlocked and locked positions. In the unlocked position, the spreader twistlock may be receivable within the second recess of the lid. In the locked position, at least one dimension of the spreader twistlock is greater than a corresponding dimension of the respective second recess, such that axial insertion and rotation or other lateral displacement serves to lock the lid to the spreader.

Rotating the spreader twistlock in a first direction may move the spreader twistlock into a locked position while moving the container twistlock into the unlocked position. Likewise, rotating the spreader twistlock in a second direction may move the spreader twistlock into the unlocked position and move the container twistlock to the locked position. In this way, the attachments of the spreader to the lid and the lid to the container can be made and unmade as needed using rotational displacement of the twistlocks as controlled from the spreader.

The container may have two twistlocks, the spreader may have two twistlocks, and the lid may have two sets of first and second recesses corresponding to the container and spreader twistlocks, respectively. In a preferred arrangement, the lid can have a plurality of fittings, with each fitting having upper and lower parallel plates separated by a distance. Said first recess may be disposed in the lower plate and said second recess may be disposed in the upper plate.

The upper and lower plates are parallel and spaced. Each has a non-round opening for receiving the insertable part of a twistlock. The lower plate interacts with an upwardly oriented twistlock on the container. The upper plate interacts with a downwardly oriented twistlock on the spreader. In the examples shown, the openings in the upper and lower plates are axially aligned and rotationally offset, for example by 90 degrees. The upper and lower twistlocks meet and rotationally engage with one another when the spreader is on the lid and the lid is on the container. As a result, one motion, such as rotation driven from the spreader twistlock, operates both twistlocks. This transfers the mechanical attachment of the lid in one direction or the other between the container and the spreader, namely detaching the lid from an existing engagement with one of the spreader and the container, and leaving the lid engaged with the other of the spreader and the container. As thus operated, the spreader can separately be twistlocked to a lid that is apart from a container, carried to the container and transferred into locked engagement with the container by subsequent operation of the same twistlock. Similarly, the spreader can be lowered onto a container having a twistlocked lid thereon, and by operation of the twistlock, the lid can be simultaneously disengaged from the container and engaged to the spreader. Although two twistlocks are involved and separately engage with one of the upper and lower plates, the two twistlocks become engaged and operate simultaneously. In the preferred arrangement, the two twistlock are axially aligned and fit into one another. It is also possible that the two twistlocks could be axially offset and coupled by gears or the like. The point is that when the one twistlock is operated, the other is operated as well.

The non-round twistlock receiving openings in the upper and lower plates attached to the lid can be generally rectangular and may be elongated in directions that are perpendicular to each other. The container and spreader twistlocks then can have generally rectangular shapes corresponding to and dimensioned to fit through the first and second recesses, each rectangular shape being carried on a shaft having a diameter less than the smaller span of the corresponding rectangular recess through which the adjacent rectangular shape is to pass. The spreader twistlock may further have a rotatable extension member disposed in a bore in the spreader to allow actuation of the twistlock at a position remote from the lid. Where the twistlock receiving openings are offset by 90 degrees, the twistlock lateral elongation directions are parallel. In that way, opening one twistlock closes the other. It is also possible to use twistlock lateral elongation directions that are perpendicular, wherein the openings are parallel. Various different alignments and gender relationships can be used to achieve this operation.

The container twistlock further may comprise a locking member and a base member, wherein the locking member is rotatably receivable within a recess in the base member, the base member is fixed to the container, and the locking and base members have corresponding stop surfaces to allow the locking member to rotate within a predetermined range. In one embodiment, the predetermined range may be about 90-degrees, and rotating the locking member 90-degrees with respect to the base member may configure the container twistlock from the unlocked position, to assume the locked position.

The container twistlock may have at least one tapered upper surface and the spreader twistlock may have a lower surface with a recess configured to engage the tapered upper surface. In the examples, the insertable twistlock structures resemble arrowheads on rotation shafts, the arrowheads being fit through slot shaped openings and turned to provide for axial locking. In this example, however, the points of the oppositely oriented arrowheads become rotationally fixed to one another when brought together, nose to nose.

The invention is particularly useful for bulk containers such as solid waste containers, having a substantially unobstructed top opening through which materials is dropped when loading the container. Advantageously, a reinforcing or structural framing rail is disposed at or adjacent to at least part of the container opening. In a preferred arrangement, the rail may comprise a tubular member with a square or rectangular cross section, mounted so as to be rotated about its longitudinal axis to direct one corner of the cross section upwardly. In this way, the rail member provides a line of contact with a lid gasket when the lid engages the container, with walls that slope away from the line of contact, both toward and away from the opening. The rail can also comprise other structures such as a bar with a wedge cross section or an angle iron with the vee point oriented upwardly, wherein at least the upper facing surface adjacent the line of contact, is inclined downwardly away from the line of contact, preferably at least on the side facing toward the opening. In one embodiment, the rail comprises rectilinear tubing (e.g., square or rectangular) rotated about its longitudinal axis to orient a sloping surface downwardly and inwardly toward the opening at an orientation. The inward sloping side can be just one or a few degrees below horizontal, up to just one or a few degrees short of being vertical. In one arrangement, the downwardly and inwardly sloping face from the highest corner (at the line of contact) is arranged between one and 45 degrees below horizontal.

In the embodiment using rectilinear tubing, the container rail further also has an outboard surface that is angled downwardly and outwardly away from the line of contact with the lid of the container or its seal. The container rail can be one of a number of frame parts that are welded to one another and to plates to form the container body.

The container further may comprise a stiffening member such as a tension bearing part extending laterally across the opening, between spaced first and second side walls adjacent the top of the container. The stiffening member minimizes bulging of the container walls when the container is filled and keeps the side walls aligned to engage with the lid. In one embodiment, the stiffening member comprises a length of chain.

An intermodal container system is disclosed comprising a container, a lid and a spreader. The container may have a top portion with an opening; and the top portion may further comprise at least one rotatable crosshead. The lid may be configured to cover at least a portion of the container opening. The lid may have at least first and second recesses, where the first recess is configured to receive the rotatable crosshead when the lid engages the container opening. The spreader may be configured to engage and the lid for handling and manipulation, and may have at least one rotatable crosshead for engaging the second recess and the container crosshead.

The container crosshead may have an insertion position in which a portion of the crosshead is receivable within the first recess, and a locked position in which a portion of the crosshead is axially retained within the recess. The spreader crosshead may further have an insertion position in which a portion of the crosshead is receivable within the second recess, and a locked position in which a portion of the crosshead is axially retained within the recess. The spreader crosshead further may have a surface for engaging a portion of the container crosshead. Thus, when the spreader crosshead is received in the second recess and configured in the locked position, and the container crosshead is received within the first recess, the spreader crosshead is operable to engage the container crosshead to configure it to the locked position.

BRIEF DESCRIPTION OF THE DRAWINGS

These and other features and advantages of the present invention will be more fully disclosed in, or rendered obvious by, the following detailed description of preferred embodiments of the invention, which are to be considered together with the accompanying drawings wherein like numbers refer to like parts, and further wherein.

DETAILED DESCRIPTION

Figure 1:
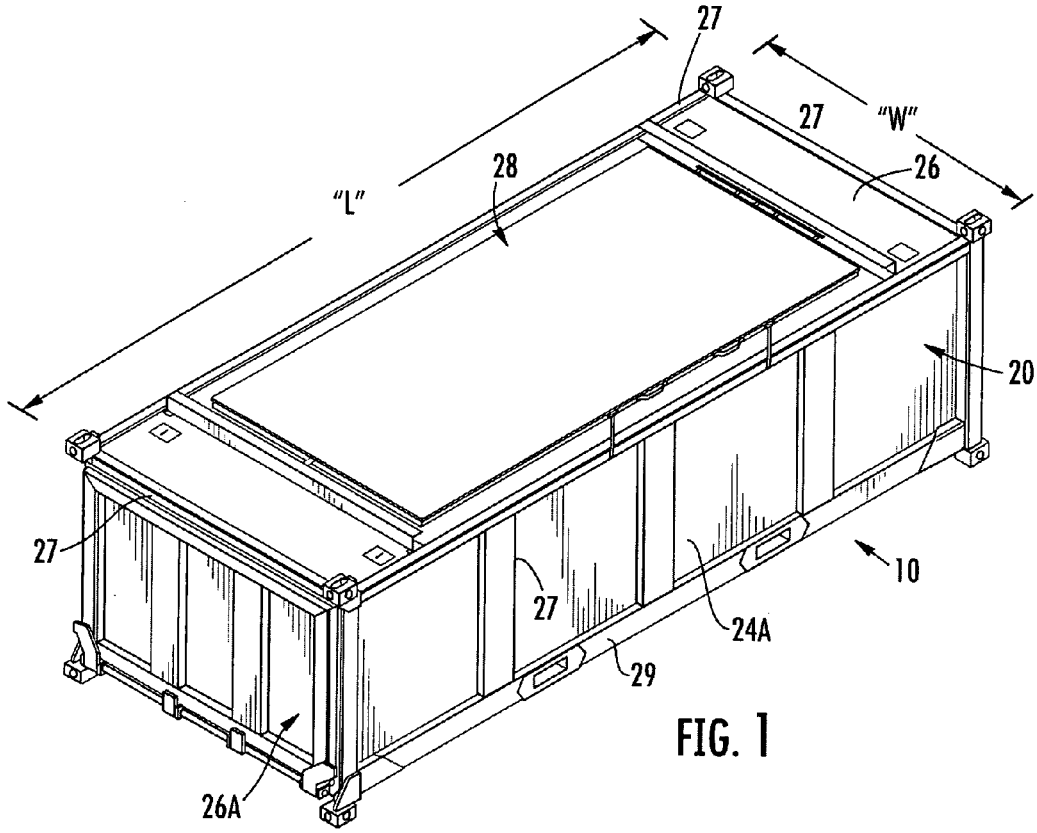
FIG. 1 is a perspective view of an intermodal container with container lid.

The foregoing arrangements are realized in certain practical examples that demonstrate one way in which the invention can be embodied. In the accompanying drawings, the same or corresponding items throughout the figures are identified by the same reference numerals. This description of examples is intended to include the accompanying drawings as part of the entire written description of this invention. However the invention should not be construed as limited to the examples that are specifically mentioned.

In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The preferred examples that are specifically illustrated have certain gender relationships that should not be construed to exclude other gender relationships that achieve a similar functions engagement. Thus, for example, a rotational engagement that might be achieved by engaging a spanner wrench or a socket wrench on a nut is wholly equivalent and should be construed to encompass the same rotational engagement if achieved by inserting a non-round tool such as an Allen wrench into a complementary non-round opening in a bolt. Insofar as the description refers in the example to parts that are inserted into openings, the description should be construed to encompass these and other forms of tool structures, as well as reversals in the gender of such parts and also to encompass arrangements in which either of the products move while the other is stationary, or arrangements in which both parts are moved.

As illustrated in FIG. 1 intermodal container 10 has a base 22, side walls 24A, B, end walls 26A, B and a top portion 26 with a central opening 28 to allow materials to be loaded therethrough. The container 10 can be made of strong and durable materials, such as steel tubing and steel plate or the like, and advantageously is rectilinearly shaped, e.g., having a rectangular profile in plan, as well as in side and end elevation. Other materials and shapes, including arbitrary shapes, are possible.

Figure 2:
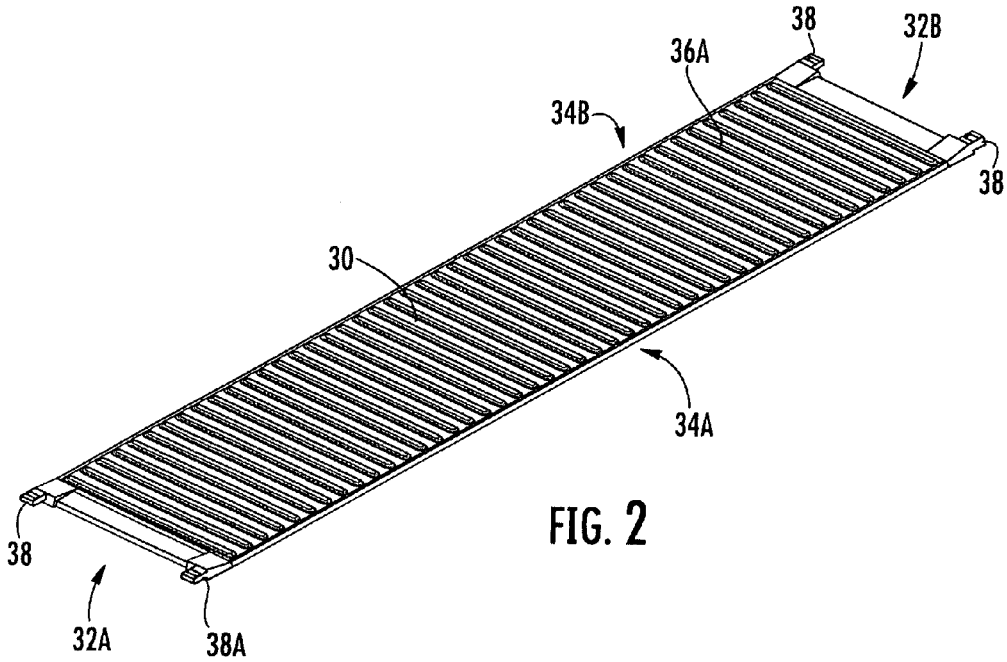
FIG. 2 is a perspective view of the container lid of FIG. 1, illustrating lid locking apertures disposed at the four corners of the lid.

The intermodal container 10 comprises a container portion 20 onto which lid 30, shown in FIG. 2, may be fit. Lid 30 is sized and configured to cover the opening 28 to enclose loaded materials within the container portion 20. Lid 30 is typically rectilinear, and can occupy nearly the full width "W" and at least a portion of the length "L" of the top 26 of the container portion 20. The lid may extend the full length as well, but in the embodiment shown the lid is shorter than the full length and does not preclude having intermodal fittings at the extreme corners that are not associated with the lid.

Different container handling applications advantageously are outfitted in different ways, depending on how they are to be used. In one embodiment, the container can have standard intermodal corner fittings at the extreme corners of the container, and the fittings employed for attachment with the lid fittings 38 are spaced inwardly from the ends. In that embodiment, different spreader arrangements may be provided in which twistlocks or other engagement mechanisms are available at a wider spacing for lifting the whole container (from the extreme corners) versus lifting the lid (from a closer spacing). The container may be handled when the lid is in place or removed. In a different arrangement, the lid can engage and disengage with the extreme corner fittings instead of dedicated lid fittings as shown. In that case, the lid fittings can be made heavy enough to lift the whole container, or the operation may be such that the lid is removed and the container is manipulated with the lid off. Other operational conditions can be envisioned wherein the lid is on or off and the container or the lid is manipulated using a different spreader or the same spreader as used with the container, optionally after adjusting the spacing of the twistlocks on the spreader.

A yieldable seal 280 (FIG. 8B) may be provided around the perimeter of the central opening 28 to tightly seal the opening when the lid 30 is secured to prevent egress of liquids and/or gases from the container 10, and to prevent ingress of liquids such as rain or condensation into the container.

FIG. 2 shows the lid 30 in greater detail. Lid 30 has first and second ends 32A, B, first and second sides 34A, B and top and bottom surfaces 36A, B. Corner fittings 38 may be disposed at each corner of the lid 30. These fittings 38 may be configured to engage corresponding structures of the container portion 20 and a lifting spreader 40 (FIG. 3) to allow the lid 30 to be manipulated using the spreader and to be selectively locked to the spreader and container portion. As will be described in more detail below, the fittings 38 may comprise upper and lower flange portions 37, 39 disposed in substantially parallel relation both to each other and to the top surface 36A of the lid. Each flange 37, 39 has a rectangular recess 138, 139, and the recesses are oriented substantially perpendicular with respect to each other (see FIG. 6). It is the flanges 37, 39 and recesses 138, 139 that interface with the engaging structures on the spreader 40 and container portion 20 to allow the lid 30 to be locked thereto.

With this arrangement, a single-piece lid 30 may be safely handled and used to cover a container of any standard length, such as 20', 28', 40', 45', 48' or 53', etc. Also, to the extent that containers of different lengths have be constructed with openings of the same size, the same lid can be used on a variety of different containers.

Figure 3:
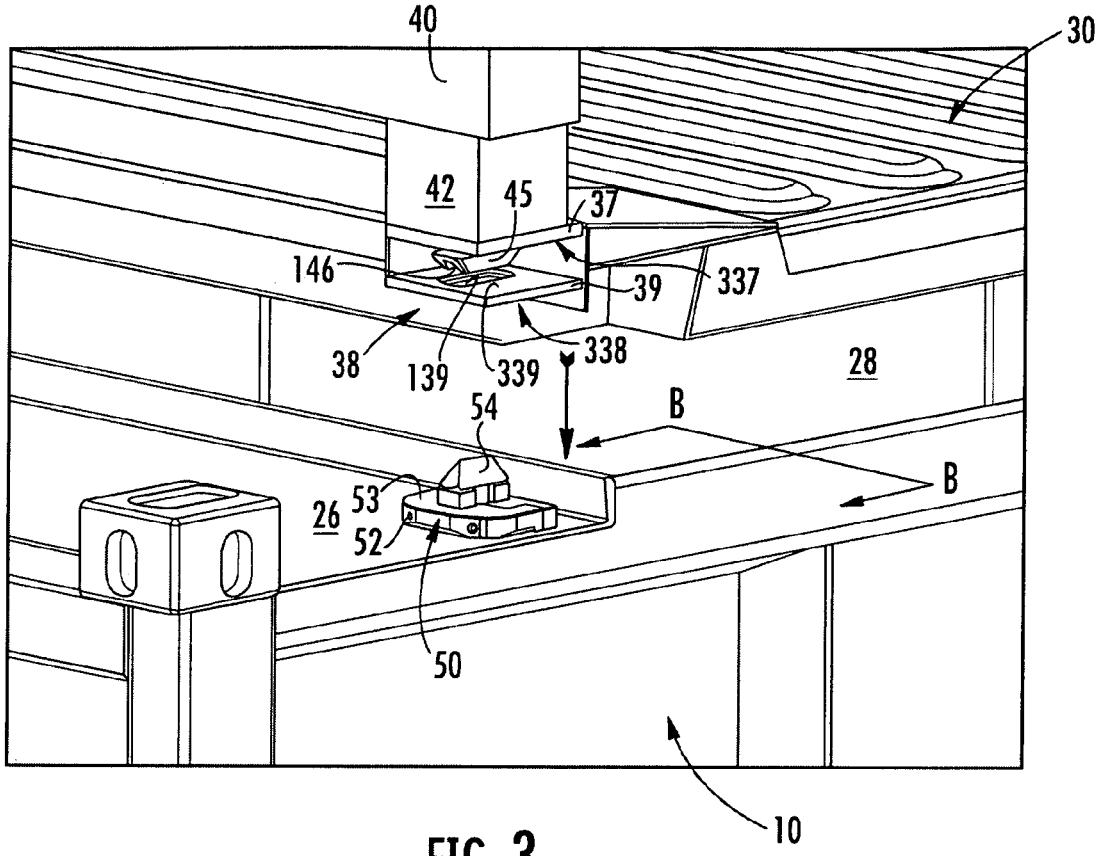
FIG. 3 is a perspective view of a portion of the container of FIG. 1 showing a twistlock member on the container and a spreader holding the container lid above the container opening, the container lid being shown in partial cutaway.

FIG. 3 shows the lid 30 engaged with the spreader 40 being lowered onto the container portion 20. It is noted that corner fitting 38 shown in FIGS. 3–6 is illustrated in partial cutaway form to more clearly illustrate the interaction of the flanges 37, 39, and their recesses 138, 139 with the structures of the spreader 40 and container portion 20. The preferred configuration of fitting 38 has the flanges enclosed as shown in FIG. 2.

Referring to FIG. 3, the spreader 40 can have at least one engagement leg 42 for engaging the lid 30, preferably having plural legs for engaging with corner fittings 38 of lid 30. Preferably, the spreader 40 has at least three engagement legs, thereby establishing the position of the lid in a plane. Most preferably, four engagement legs for engaging the four corner fitting 38 of the lid 30. Each engagement leg 42 has a rotatable member 44 received within a bore 46 (FIG. 4) that extends from a top surface 41 of the spreader 40 to a bottom surface 43 (FIG. 6) of the leg 42 (see FIGS. 4, 5 and 6). The rotatable member 44 has a first end 48 that may extend beyond the spreader top surface 41 for engaging an actuating tool (not shown). The second or lower end 49 (FIG. 6) of the rotatable member 44 may extend beyond the bottom surface of the leg 43 for engaging a rotatable spreader-twistlock 45. The spreader twistlock 45 may be fixed to the rotatable member 44 such that turning the member serves to turn the twistlock.

Some or all of the rotatable members 44 can be mounted in a manner that will admit of some freedom or play for the axis of the rotatable member to depart laterally from it nominally centered position in leg 42. This aspect allows the end of the twistlock device, which is somewhat tapered toward a blunt point, to engage with the opening in a receiving fitting when aligned slightly off center, nevertheless bringing the twistlock (as well as all the associated twistlocks) into sufficiently accurate engagement that the twistlocks can all readily engage.

A mounting providing for such lateral freedom or play can be obtained by mounting the journal for each rotatable member in a box-like frame having clearance and to place springs or similarly resilient members on radially opposed sides shaft of member 44 so as to seek a centered position but to permit lateral displacement. Various manufacturers of known twistlocks for container tiedowns, top-lift spreaders and the like have fittings with lateral play, mounted for example between opposed Bellville washers.

In the illustrated embodiment, the spreader-twistlock 45 has a generally rectangular top surface 145 and a bottom surface 146 comprising a substantially U-shaped channel. To engage the spreader 40 with the lid 30, the twistlocks 45 are rotated to generally align with the rectangular upper rectangular recesses 138 in the upper flanges 37 of the respective corner fittings 38. The spreader 40 is then lowered onto the lid 30 so that the spreader-twistlocks 45 enter the upper recesses 138. When fully seated, the bottom surface 43 of each engagement leg 42 engages the top surface 238 of each corner fitting 38 and the top surface 145 (FIG. 6) of the spreader-twistlock 45 is disposed slightly below the lower surface 337 of the upper flange 37 so that the twistlock may be freely rotated. The rotatable member 44 associated with each spreader-twistlock 45 is then turned approximately 90-degrees to rotate the twistlock out of alignment with the recess 138, thereby locking the spreader leg 42 to the corner fitting 38. After the legs 42 have been locked to the corner fittings 38, the spreader may be used to manipulate the lid 30.

The rotatable member 44 can be driven using more or less complicated unpowered (manual) techniques, or pneumatic, hydraulic or electrically powered techniques. For example, rotation of member 44 may be caused by pivoting a crank handle protruding laterally for manual operation (not shown). A powered cylinder can be employed as well. The object in any case is to rotate between positions that are 90 degrees offset. When the device is aligned, and the spreader is lowered, the weight of the spreader (and also the lid if being carried) urge the spreader twistlock mechanism down toward the container and toward engagement for operation.

Rotating the spreader twistlock into alignment with the lid opening permits the spreader twistlock to become inserted or to be lifted from the fitting in the lid. Also, rotation of the spreader twistlock when inserted into the upper flange 37 of the lid causes the spreader to engage or disengage the lid mechanically, because the downwardly insertable rotatable part of the spreader and the opening in upper flange 37 attached to the lid for receiving it, are complementary and non-round. Likewise, the upwardly insertable rotatable part 54 of container twistlock has a similar insert-and-twist locking relationship with a lower flange 39. Importantly, the oppositely oriented insertable parts 54, 45 of the container and the spreader, respectively, fit together so that the two must rotate as a unit. As a result, rotating the spreader twistlock causes rotation of the container twistlock when the two are engaged (or vice versa). Using any powered means or tool or handle to rotate the shafts of the engaged oppositely oriented twistlocks. According to the invention, this allows the spreader, lid and container to be controllably operated in a complementary way. Alignment of the spreader twistlock to the opening in the upper flange 37 allows insertion of the nose of twistlock 45 into upper flange, where rotation of twistlock 45 by 90 degrees will mechanically engage the spreader to the lid. Subsequent rotation back to the original position permits disengagement and retraction.

Either of the rotationally engaged nose parts of the twistlocks 45 and 54 can be the functionally male or female part. Alternatively, the two can be splined on axially facing ends so that they lock rotationally by interengagement, or complementarily shaped such that one can fit the another like a driver in a socket or a socket wrench on a nut.

In the disclosed embodiments, the twistlocks 45, 54 are aligned coaxially and are axially brought together to engage with one another like a wrench and a bolt. It is also possible for the twistlocks 45, 54 to be mounted on shafts that are laterally displaced from one another, with a technique other than non-round complementary engagement of coaxial parts used to couple the twistlocks such that rotation of one causes rotation of the other. For example, the twistlocks can have a geared relationship (not shown).

In any event, twistlock 45 engages with respect to twistlock 54 so that the two rotate in unison. Twistlock 54 has a similar relationship with lower flange 39 as twistlock 45 has with upper flange 37, but in this embodiment the openings in flanges 37, 39 are offset by 90 degrees, whereas the twistlock arrowhead parts are rotationally parallel in that their directions of lateral elongation are aligned.

One of the twistlocks 45, 54 is rotated using any tool or handle or powered mechanism, thereby rotating both the twistlocks 45, 54 when engaged. Such rotation simultaneously effects two functions. Rotation in one direction can affix the spreader to the lid while simultaneously detaching the lid from the container. Rotation in the other direction (or perhaps further rotation in the same direction if mechanically permitted) can detach the spreader from the lid while simultaneously affixing the lid on the container. Preferably, a twist left or right by 90 degrees achieves these two different functions of (1) locking the spreader into the lid while also automatically disengaging the lid from the container (so the container is opened and the lid can be lifted clear); and (2) unlocking the spreader from the lid while also automatically engaging the lid on the container (so the lid closes and attaches to the container and the spreader can be lifted clear).

Figure 4:
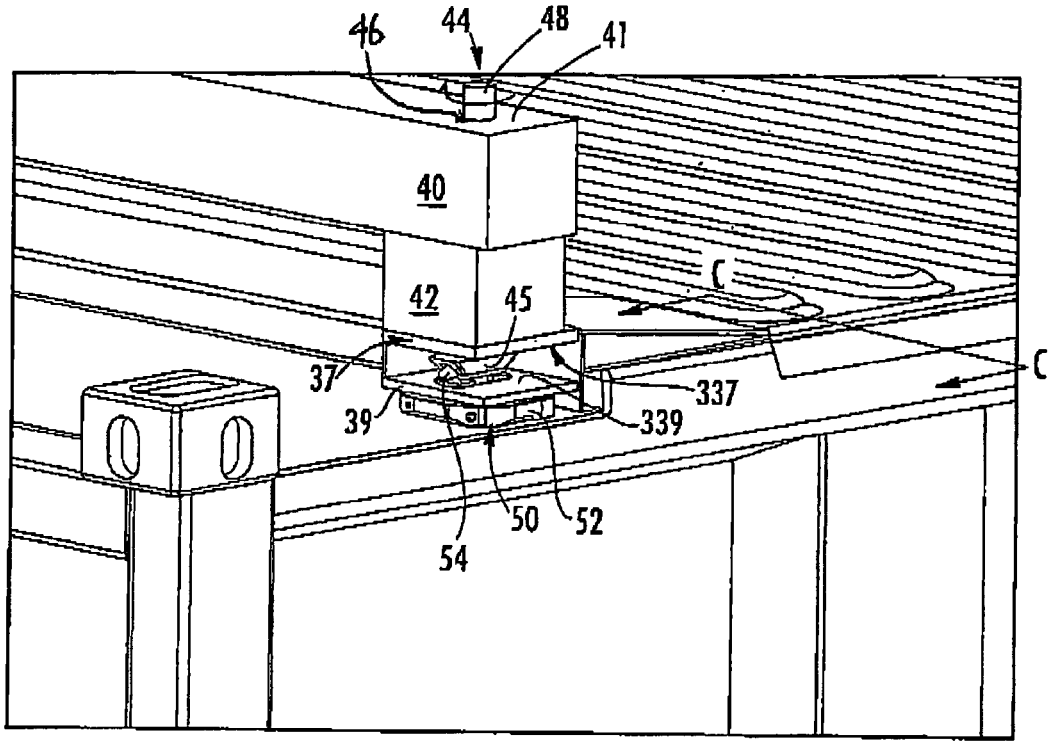
FIG. 4 is a perspective view of the container as shown in FIG. 3 in which the container lid is engaged with the twist locking member and the spreader.

FIG. 3 shows the spreader 40 being used to lower the lid 30 down onto the container 10 while the lid is carried on the spreader and detached from the container. As can be seen, a container-twistlock assembly 50 is mounted on the top surface 26 of the container 10 in substantial alignment with the corner fitting 38 of the lid 30. Preferably four container-twistlocks 50 are provided, one corresponding to each corner fitting 38. The container-twistlock assembly has a base portion 52 and a locking portion 54. In the illustrated embodiment, locking portion 54 comprises a rectangular-shaped flange element that generally corresponds to the shape of the recess 139 in the lower flange 39 of corner fitting 38. The locking portion 54 is rotatably movable with respect to the base 52, and is sized and configured so that, when properly aligned, it is receivable within the lower rectangular recess 139 of the corner fitting 38. FIG. 3 shows the locking portion 54 substantially aligned with the lower recess 139 so that the lid 30 can be lowered onto the container 10. FIG. 4 shows the lid 30 fully seated on the container 10 such that the lower surface 338 of the corner fitting 38 rests on the upper surface 53 of the container-twistlock base 52.

The upper surfaces 540A, B of the container-twistlock locking portion 54 can be tapered (FIGS. 7A–C) to facilitate alignment of the container-twistlock with the lower recess 139 and the u-shaped lower surface 146 of the spreader-twistlock 45. Thus, when the lid 30 is fully seated on the container 10, the upper surface 540A of the container-twistlock 50 firmly engages the lower surface 146 of the spreader twistlock 45.

In the illustrated embodiment, the locking portion 54 forms a rectangular pyramidal structure, with a pair of elongated major surfaces 540A joined by a pair of minor surfaces 540B. It is noted that this arrangement merely facilitates the alignment of the container-twistlock with the respective lower recess 139 of the lid 30 and spreader twistlock 45 during use, and is not critical. As such, a variety of corresponding surface geometries may be substituted, as will be appreciated by one of skill in the art.

Figure 5:
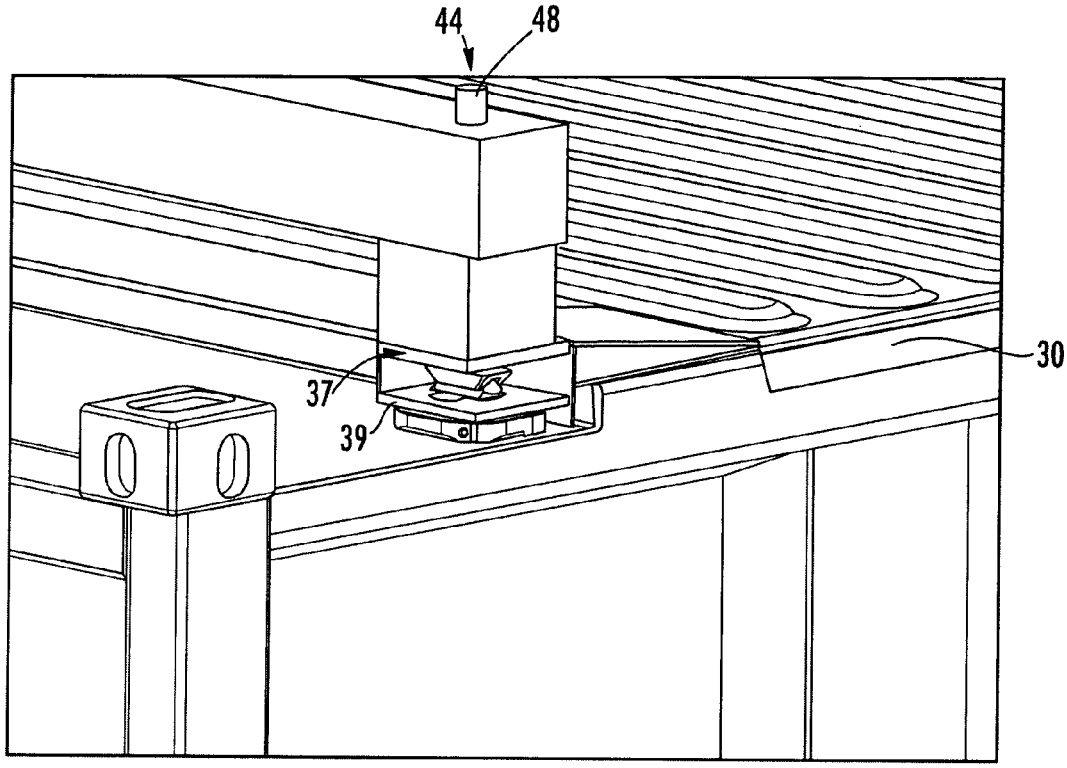
FIG. 5 is a perspective view of the container of FIG. 3 in which the twistlock has been rotated to engage the lid locking aperture.
Figure 6:
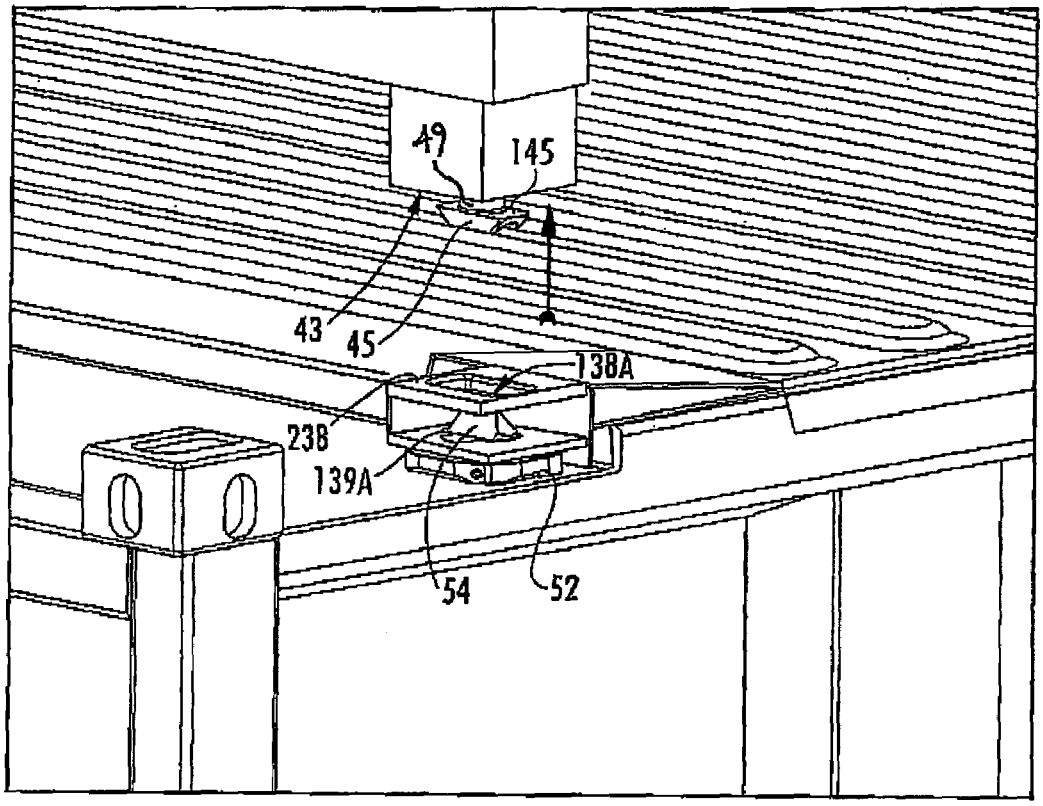
FIG. 6 is a perspective view of the container of FIG. 3 in which the spreader has disengaged from the lid locking aperture, leaving the lid locked to the container.

Referring again to FIG. 4, once the lid has been lowered onto the container and the spreader-twistlock 45 is engaged with the locking portion 54 of the container-twistlock 50, the rotatable member 44 on the spreader 40 are rotated approximately 90-degrees so that the spreader, lid and container assume the configuration of FIG. 5. As can be seen in FIG. 5, the movement of rotatable member 44 causes the spreader-twistlock 45 and the locking portion 54 of the container-twistlock 50 to turn by the same amount, which causes the spreader twistlock 45 to re-align with the upper recess 138, thereby unlocking the lid from the spreader 40, and causes the locking portion 54 of the container-twistlock 50 to be moved out of alignment with the lower recess 139, thereby to lock the lid 30 to the container 10. In this manner, the lid 30 is simultaneously locked to the container 10 and unlocked from the spreader 40. As shown in FIG. 6, he spreader 40 can then be lifted up off the lid 30, leaving the lid locked to the container 10. The lid 30 may be unlocked from the container 10 and locked to the spreader 40 by implementing the above procedure in reverse.

Thus, the present invention advantageously allows a user to switch a container lid 30 between a lifting spreader 40 and an intermodal container 20 in a minimum of operational steps, thereby increasing safety and reducing the total amount of time required to lock and unlock the lid.

The container twistlock assembly 50 also may be operated without the spreader 40. In such a case, a detachable tool and tool engagement fitting (such as a nut or socket) can be provided to receive a wrench. Alternatively, a permanently attached lever or the like may be provided, having an actuating end configured similarly to the lower surface 146 of the spreader twistlock 45 and used manually to engage and rotate the locking portion 54 of the container twistlock 50. Powered fittings can also be used, such as pneumatic cylinder operated for example against pressure of a biasing spring by coupling to a source of compressed air (not shown).

Figure 7A:
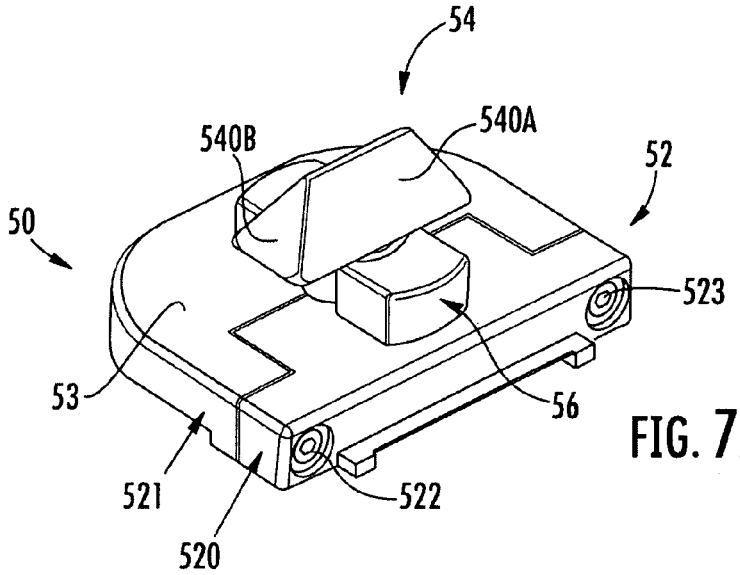
FIGS. 7A through 7C are perspective, transparent plan, and elevation views, respectively, of the twistlock mechanism of FIG. 3.
Figure 7B:
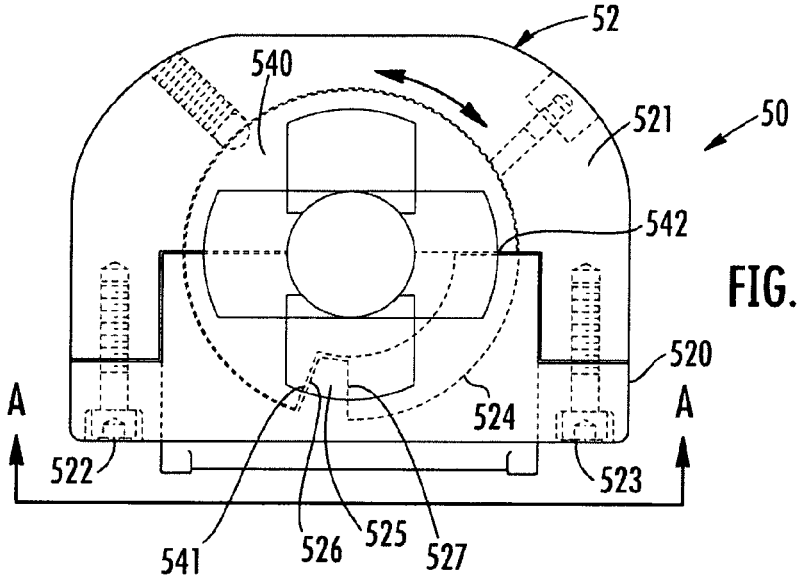
Figure 7C:
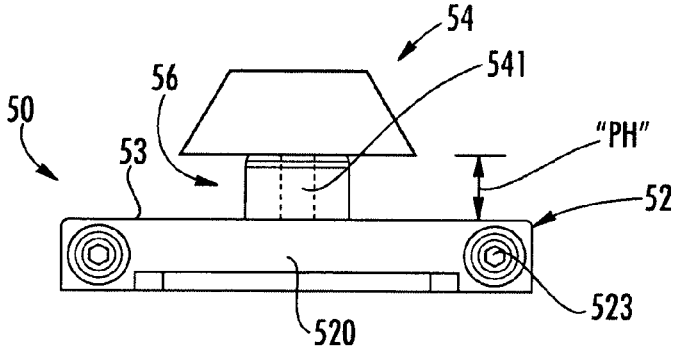

FIGS. 7A through 7C show the container-twistlock assembly 50 in greater detail. As previously described, the assembly comprises a base portion 52 and a locking portion 54. The assembly may also have a pedestal portion 56 disposed between the base and locking portions 52, 54. This pedestal portion 56 has a height "PH" slightly greater than the thickness of lower flange 39 to ensure that when the lid 30 is seated on the container portion 20 such that the lid corner fitting 38 rests on the upper surface 53 of the twistlock assembly base portion 52, the locking portion 54 is positioned above the top surface 339 of lower flange 39 so as to be freely rotatable. Thus the pedestal portion 56 is shaped to match the rectangular shape of the recess 139 in lower flange 39.

Base portion 52 may comprise first and second interlocking portions 520, 521 fixed together by first and second fasteners 522, 523, which in the illustrated embodiment are machine screws. The first and second portions 520, 521 may form an internal cavity 524 to receive a cylindrical extension 540 of locking portion 54 to axially retain the locking portion to the base portion 52 and also to limit the rotation of the locking portion 54 to a predetermined range. In one embodiment, this predetermined range is approximately 90-degrees.

The base portion 52 may be affixed to the top portion 26 of the container 20, for example, by welding. Other fastening methods are also contemplated, such as adhesives, bolting, etc. In one embodiment, only the second 521 portion is affixed to the container top 26, and the first portion 520 is removable to allow quick and easy replacement of a damaged or worn locking portion 54, simply by removing and reinstalling fasteners 522, 523.

As shown in FIG. 7B, the first and second portions 520, 521 each form one half of internal cavity 524. The first portion 520 further comprises an inner stop 525 that projects into the cavity 524 to form a pair of stop surfaces 526, 527 configured to mate with corresponding stop surfaces 541, 542 of the cylindrical extension 540 to limit rotation of the extension within the cavity. Thus the cylindrical extension 540 can rotate clockwise or counterclockwise within the cavity 524 until the respective stop surfaces 527, 542; 526, 541 engage each other. As will be appreciated, the inner stop 525 and the cylindrical extension 540 can be configured to permit any desired range of rotation between the locking portion 54 and the base portion 52.

As previously noted, the illustrated embodiment allows approximately 90-degrees of respective rotation between the portions 52, 54. This range is designed to provide the user with two distinct operational positions for the system, the first in which the lid 30 is locked to the spreader 40 and the second in which the lid is locked to the container portion 20.

In the first position, the locking portion 54 is rotated clockwise until stop surfaces 527 and 542 engage each other, which aligns the locking portion 54 with the lower recess 139 in the corner fitting 38 of lid 30. Lid 30 may then be lowered onto the container portion 20 until fitting 38 contacts the base portion 52 of the container-twistlock 50. Since the locking portion 54 is aligned with recess 139, it is also be aligned with the spreader-twistlock 45, and as the lid is lowered onto the container the locking portion 54 is received within the bottom u-shaped channel 146 of the spreader-twistlock 45.

To obtain the second position, rotatable member 44 is turned counter-clockwise, which in turn rotates the spreader-twistlock 45 and the locking portion 54 of the container-twistlock, until stop surfaces 526 and 541 engage each other. In this second position, the locking portion 54 is oriented perpendicular with respect to the lower recess 139 of the lid corner flange 39, and spreader-twistlock 45 is aligned with the upper recess 138 of the lid flange 39. As noted, in the second position the spreader 40 is unlocked from the lid 30 and may be lifted off.

As will be appreciated, this arrangement eliminates the need for the user to measure or monitor the exact amount of rotation that is applied to the rotatable member 44 to obtain a desired locking/unlocking of the components. The user can simply rotate the member 44 in the desired direction until the respective stop surfaces are engaged to be assured of the configuration of the system. As such, the spreader 40 and the rotatable member 40 may be labeled to indicate whether the system is in the first or second position. These labels may be engraved, stamped or painted onto the appropriate surfaces of the components.

Figure 8A:
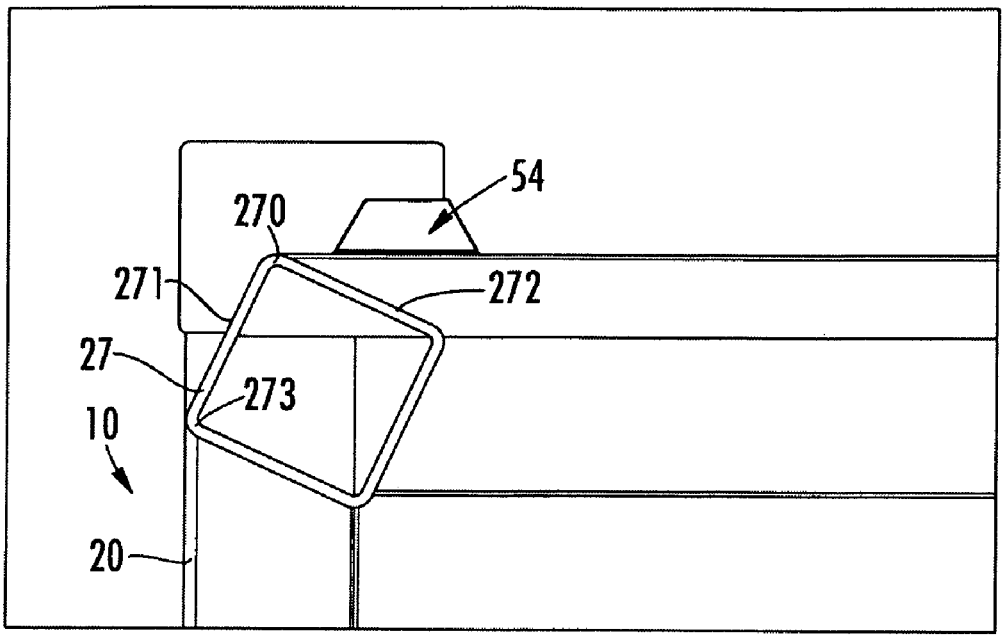
FIGS. 8A and 8B are cross section views of the engagement of the container and container lid of FIG. 1.
Figure 8B:
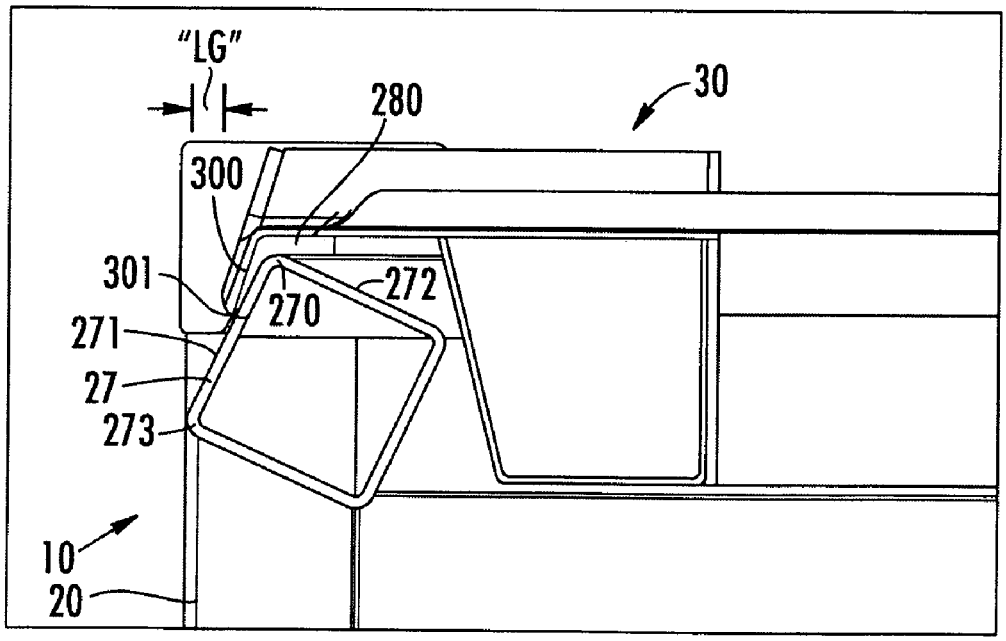

FIGS. 8A and 8B show the interaction between the lid 30 and the container portion 20 of intermodal container 10. FIG. 8A is a cross-section view of the container portion 20 taken along line B—B in FIG. 3, while FIG. 8B is a cross-section view of the container portion 20 and lid 30 taken along line C—C in FIG. 4. Referring back to FIG. 1, the top portion 26 of the container portion 20 is bounded by a top rail 27 which provides structural strength and rigidity to the container 10. In FIGS. 8A and 8B, this top rail 27 comprises a square tubular member that has been rotated about its longitudinal axis so as to present an upper corner 270 with corresponding downward sloping side surfaces 271, 272. This arrangement differs from standard container arrangements in which the top rail is oriented to present a flat upper surface that is generally parallel with the top surface of the container. The amount of rotation provided can be from about 1-degree to about 45-degrees compared to the traditional flat top rail arrangement.

In particular, as compared to traditional flat top rails, the rotated top rail 27 provides increased resistance to bending when forces are applied to the inside of the container side walls 24A, B. This arrangement would thus allow the use of a smaller top rail 27 without compromising the overall strength of the container 10. Further, as compared to the traditional flat top rail arrangement, the rotated top rail 27 design has increased resistance to deformation and damage that can occur due to impacts with loading equipment.

Additionally, the top corner 270 of the rotated top rail 27 provides enhanced sealing with the elastomeric lid gasket 280 because the sealing force is concentrated along the top corner 270 of the rail 27, rather than across an entire flat face (e.g. surface 272) as occurs with traditional designs.

The rotated top rail 27 also tends to shed materials from its angled sides 271, 272, such as when materials are spilled from above onto the container 10. With traditional designs, such materials may tend to lie on the flat upper surface of the top rail, requiring additional operator action to clear the surface prior to engaging the lid.

The angled outer rail surface 271 also may perform an alignment function, serving to guide a corresponding inner angled surface 300 of the lid 30 into place on the container portion 20 during installation.

Further, the rotated top rail 27 can protect the lid from side impact forces applied to the container portion 20. The lower outer corner 273 of the top rail 27 is positioned substantially flush with the associated side wall 24A, B, thus disposing the angled outer rail surface 271 and the top corner 270 of the rail slightly inboard from the side walls. This allows the lid 30 to be manufactured slightly narrower than the width "W" of the container 10, since the lid need only be wide enough to engage the top corner 270 (to seal the gasket 280) and angled outer rail surfaces 271 of the container. The resulting gap "LG" between the side wall 24A, B and the lid outer edge 301 serves to isolate the lid 30 from loads applied to the container side walls 24A, B.

A similar rotated bottom rail 29 can be used, and can provide many of the same advantages over traditional designs as the rotated top rail 27, including increased resistance to bending and loading impacts, increased shedding of materials dumped from above, as well as easy cleanup of the container interior.

Figure 9:
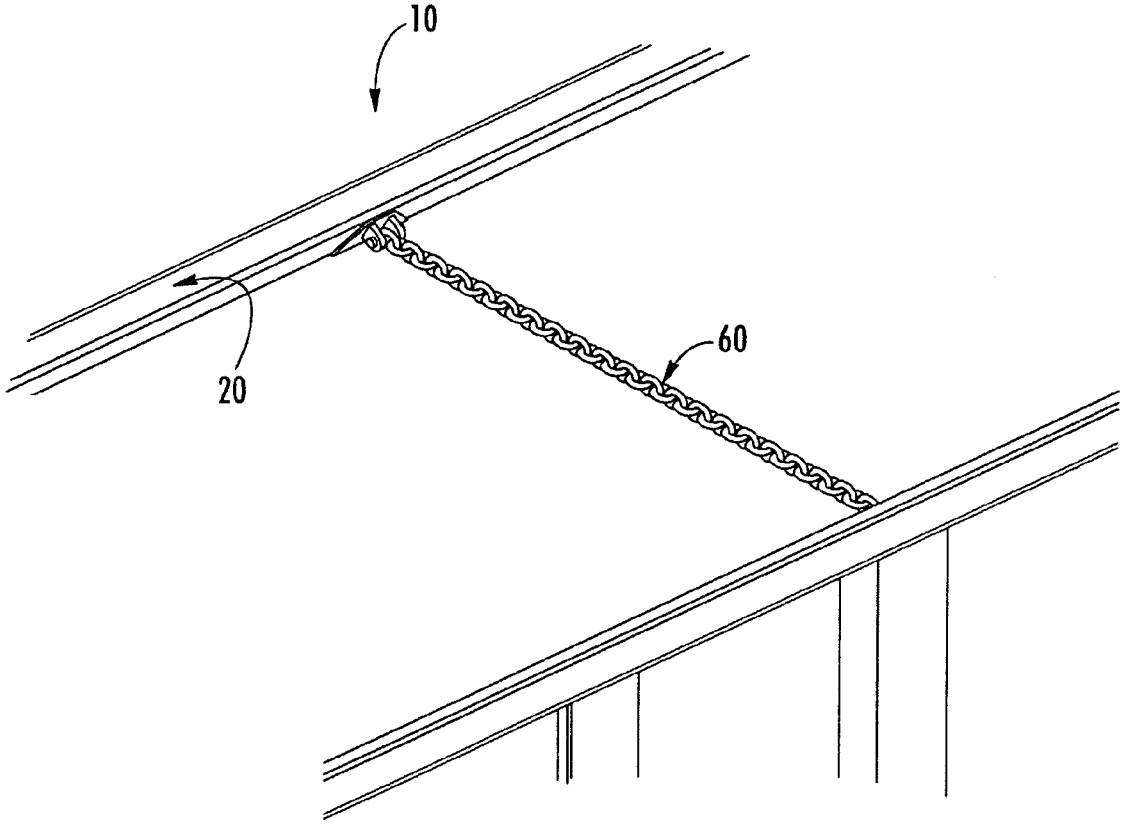
FIG. 9 is a perspective view of a stabilizing chain header of the intermodal container of FIG. 1.

FIG. 9 shows a stiffening member 60 for use with the container portion 20 to enhance the engagement between the lid 30 and the container portion 20. The stiffening member 60 can be attached to opposing side walls 24A, B of the container near the top surface 27. As previously noted, intermodal containers of the type disclosed herein can be used to contain and transport a variety of materials. Where very heavy materials (e.g. metals, concrete, etc.) are being transported in the container 10, substantial forces may be imparted on the side walls 24A, B, which in turn can cause bulging of the container. This bulging can expand the width "W" of the container at discrete locations, notably near the top center of the container where the lateral stiffness of the container is at its lowest value. Severe bulging can compromise the interaction between the container portion 20 and the lid 30, and in the extreme case may prevent the lid from properly engaging the container-twistlocks 50. Providing a stiffening member 60 such as the illustrated chain element can increase the lateral stiffness of the container at the top center region to prevent side load bulging, and thereby ensuring proper engagement with the lid 30.

Although the stiffening member 60 is shown as comprising a pinned chain element, other appropriate stiffening structures may be provided, such as solid bar elements, etc.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A handling system for an intermodal container lid, comprising:

a container having a top portion with an opening for receiving materials to be contained therein, the top portion further comprising at least one rotatable twistlock disposed adjacent to the opening;

a lid for engaging the container and covering at least a portion of the opening, the lid having at least first and second engagement recesses, the first recess configured to receive the rotatable twistlock when the lid engages the container;

a spreader for manipulating the lid; the spreader having at least one rotatable twistlock for engaging the second recess, wherein the spreader twistlock and the container twistlock are engageable with and disengageable from each other and are rotationally affixed relative to one another when the spreader engages the lid;

wherein the container twistlock has unlocked and locked positions, in the unlocked position the container twistlock being receivable within the first recess, and in the locked position at least one dimension of the container twistlock being greater than a corresponding dimension of the respective first recess, so as to lock the lid to the container;

wherein the spreader twistlock has unlocked and locked positions, in the unlocked position the spreader twistlock being receivable within the second recess, and in the locked position at least one dimension of the spreader twistlock being greater than a corresponding dimension of the second recess so as to lock the lid to the spreader; and, wherein rotating the spreader twistlock in a first direction configures the spreader twistlock to the locked position and configures the container twistlock to the unlocked position.

2. The handling system of claim 1, wherein rotating the spreader twistlock in a second direction configures the spreader twistlock to the unlocked position and configures the container twistlock to the locked position.

3. The handling system of claim 2, further comprising two container twistlocks, two spreader twistlocks, and two sets of first and second recesses corresponding to the container and spreader twistlocks.

4. The handling system of claim 2, the lid further comprising a plurality of fittings, each fitting having upper and lower parallel plates separated by a distance, wherein the first recess is disposed in the lower plate and the second recess is disposed in the upper plate.

5. The handling system of claim 4, wherein the recesses are laterally elongated in at least one direction from a common rotation axis of the container and spreader twistlocks, and wherein the directions of such lateral elongation are rotationally offset with respect to each other such that if either of the twistlocks is aligned to its respective one of the recesses, the other of the twistlocks is misaligned relative to its one of the recesses.

6. The handling system of claim 5, wherein the spreader twistlock is generally rectangular to correspond to the second recess, the spreader twistlock further has a rotatable extension member disposed in a bore in the spreader to allow actuation of the twistlock at a position remote from the lid.

7. The handling system of claim 5, wherein the container twistlock is generally rectangular to correspond to the first recess and wherein the first and second longitudinal axes are perpendicular to one another.

8. The handling system of claim 5, the container twistlock further comprising a locking member and a base member, wherein the locking member is rotatably receivable within a recess in the base member, the base member is fixed to the container, and the locking and base members have corresponding stop surfaces to allow the locking member to rotate within a predetermined range.

9. The handling system of claim 8, wherein the predetermined range is about 90-degrees.

10. The handling system of claim 8, wherein rotating the locking member 90-degrees with respect to the base member configures the container twistlock from the unlocked to the locked position.

11. The handling system of claim 10, wherein the container twistlock has at least one tapered upper surface and the spreader twistlock has a lower surface with a recess configured to engage the tapered upper surface.

12. The handling system of claim 1, wherein the container further has a rail disposed adjacent at least a portion of the opening, the rail comprising a square tubular member that is rotated about its longitudinal axis such that one corner of the member provides a line contact with a lid gasket.

13. The handling system of claim 12, wherein the square tubular member is rotated about it longitudinal axis in the range of from about one to about 45 degrees.

14. The handling system of claim 13, wherein the container rail further has an outboard surface that is angled with respect to the top portion of the container to engage a correspondingly angled surface of the lid to facilitate engagement of the lid to the container.

15. The handling system of claim 14, wherein the container has a stiffening member disposed between the first and second side walls adjacent the top of the container to minimize bulging when the container is filled, thus facilitating engagement of the lid to the container.

16. The handling system of claim 15, wherein the stiffening member comprises a length of chain.

17. An intermodal container system comprising:

a container having a top portion with an opening; the top portion further comprising at least one rotatable crosshead;

a lid for covering at least a portion of the container opening, the lid having at least first and second recesses, the first recess configured to receive the rotatable crosshead when the lid engages the opening;

a spreader for handling the lid; the spreader having at least one rotatable crosshead for engaging the second recess and the container crosshead;

the container crosshead further having an insertion position in which a portion of the crosshead is receivable within the first recess, and a locked position in which a portion of the crosshead is axially retained within the recess;

the spreader crosshead further having an insertion position in which a portion of the crosshead is receivable within the second recess, and a locked position in which a portion of the crosshead is axially retained within the recess; the spreader crosshead further having a surface for engaging a portion of the container crosshead;

wherein the spreader crosshead and the container crosshead are selectively engageable with and disengageable from each other such that when the spreader crosshead is received in the second recess and is configured in the locked position, and the container crosshead is received within the first recess, the spreader crosshead is operable to engage the container crosshead to configure it to the locked position.

* * * * *